US005140727A

United States Patent [19]

Dais et al.

[11] Patent Number: 5,140,727

[45] Date of Patent: Aug. 25, 1992

[54] ZIPPER FOR RECLOSABLE THERMOPLASTIC BAG, PROCESS AND APPARATUS FOR MAKING

[75] Inventors: Brian C. Dais; Jose Porchia, both of Midland; John O. McCree, Saginaw; David A. Smith; Larry M. Zieke, both of Midland, all of Mich.

[73] Assignee: Dowbrands L.P., Indianapolis, Ind.

[21] Appl. No.: 688,230

[22] Filed: Apr. 22, 1991

Related U.S. Application Data

[63] Continuation-in-part of Ser. No. 531,931, Jun. 1, 1990, which is a continuation-in-part of Ser. No. 491,389, Mar. 6, 1990, abandoned.

[51] Int. Cl.[5] ..... A44B 17/00

[52] U.S. Cl. ..... 24/587; 24/400; 24/577; 383/65

[58] Field of Search ..... 24/587, 577, 576, 399, 24/400, 389, 437; 383/13, 35, 63, 65, 68

[56] References Cited

U.S. PATENT DOCUMENTS

| | | | |
|---|---|---|---|
| 2,035,674 | 3/1936 | Sipe | 383/68 |
| 3,338,284 | 8/1967 | Ausnit | 24/587 |
| 3,416,585 | 12/1968 | Staller | 24/587 |
| 4,191,076 | 3/1980 | Bollmer et al. | 24/587 |
| 4,736,451 | 4/1988 | Ausnit | 24/587 |
| 4,736,496 | 4/1988 | Fisher et al. | 24/587 |
| 4,812,056 | 3/1989 | Bieke | 24/587 |
| 4,941,238 | 7/1990 | Clark | 24/437 |

FOREIGN PATENT DOCUMENTS

| | | | |
|---|---|---|---|
| 1226817 | 10/1966 | Fed. Rep. of Germany | 24/400 |
| 2504863 | 8/1976 | Fed. Rep. of Germany | 24/399 |

*Primary Examiner*—Victor N. Sakran

[57] ABSTRACT

A zipper for a reclosable thermoplastic bag which produces an audible clicking sound and/or a vibratory or bumpy feel when closed or "zipped", and processes and apparatus for making such zippers.

12 Claims, 9 Drawing Sheets

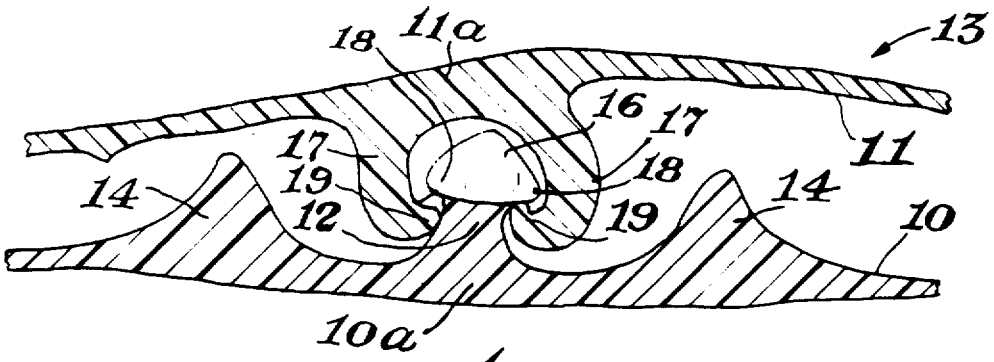
Fig. 2
Fig. 3
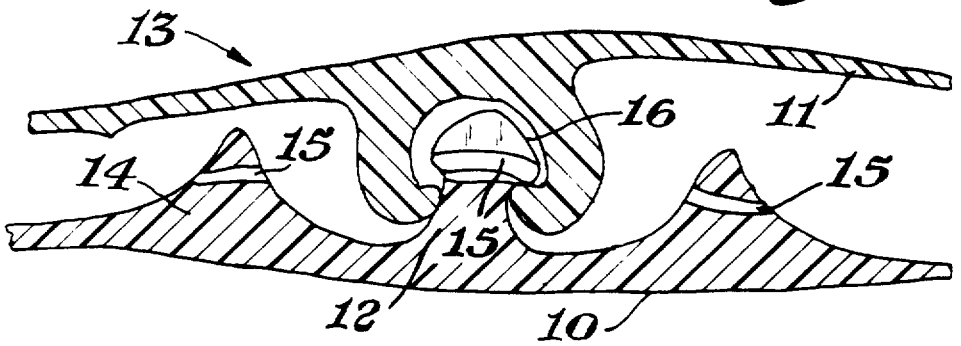
Fig. 4
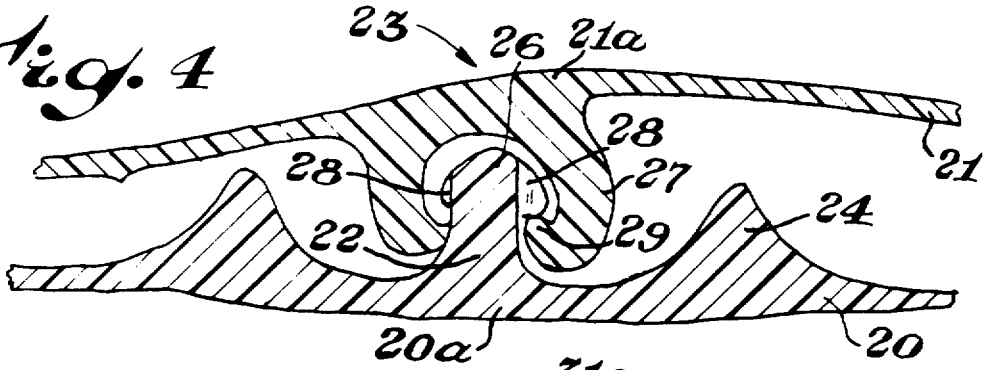
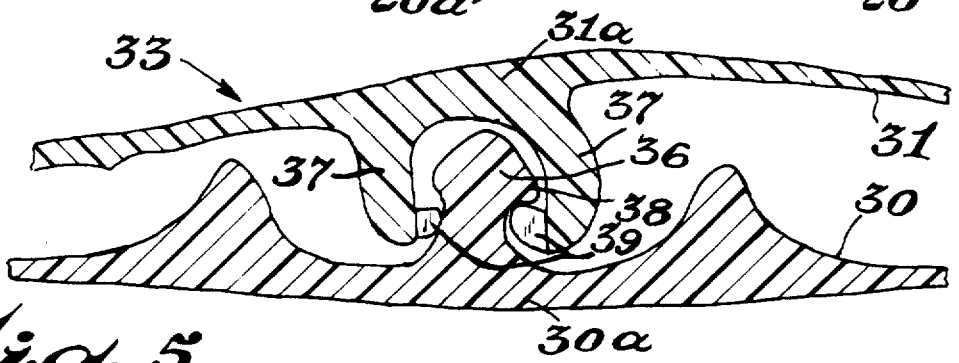
Fig. 5

ZIPPER FOR RECLOSABLE THERMOPLASTIC BAG, PROCESS AND APPARATUS FOR MAKING

CROSS-REFERENCE TO RELATED APPLICATIONS

This application is a continuation-in-part application of copending U.S. Ser. No. 07/531,931 filed Jun. 1, 1990, which is a continuation-in-part of U.S. Ser. No. 07/491,389, filed Mar. 6, 1990, now abandoned.

BACKGROUND OF THE INVENTION

Reclosable thermoplastic bags with zipper-type closures have come into widespread use. The problem addressed by the present invention pertains to the determination of whether or not the zipper of a reclosable plastic bag is properly closed or "zipped". Such a determination is often difficult save with a close visual inspection of the zipper.

One known way of making the determination easier is to use a zipper which provides a color change when the zipper is properly zipped. Different colors are utilized in each of the opposing zipper profiles to produce a third distinct color when the profiles are interlocked. Zippers utilizing such a color change are seen in U.S. Pat. Nos. 4,186,786 and 4,285,105. The disadvantage of using such a color change is that it may occur when the opposing zipper profiles are closely overlapped instead of only when the profiles are properly interlocked.

SUMMARY OF THE INVENTION

The present invention provides a zipper for a reclosable thermoplastic bag that closes with a vibratory or bumpy feel and/or produces an audible clicking sound along its length when being closed, so that the fact of closure can be confirmed preferably both by sound and feel in addition to, or to the exclusion of, the close visual inspection required with previous zipper structures.

According to the present invention, a zipper for a reclosable thermoplastic bag comprises two opposing, longitudinally extending interlockable rib and groove profiles wherein at least one of the profiles has a longitudinally extending part interlockable with the opposing profile, and wherein the part is substantially free of interdigitation with the opposing profile and has indentions within and intermittently along its length or more generally is discontinuous in structure along its length. These intermittent indentions or structural discontinuities define segments of differing shape along the length of the part. The profiles by reason of these indentions, structural discontinuities or segments close or zip with a vibratory or bumpy feel or with an audible clicking sound, or preferably with both a bumpy feel and an audible clicking sound over the length of the segmented part when the profiles are interlocked.

Several processes for making such zippers have been developed as part of the invention along with associated apparatus. One such process involves the continuous, steady state extrusion of a zipper profile and its periodic deformation to form intermittent indentions in the profile along its length. In another process and its related apparatus, the zipper profile is extruded continuously at a constant rate and portions of the profile are removed periodically to form the indentions or structural discontinuities in the profile. In yet another process, the polymer flow from the profile extruder is increased or decreased intermittently. In this last process, the segments of the profile part are larger and smaller sections of the profile where polymer flow is highest or lowest, respectively. The gaps between these larger and smaller sections form the structural discontinuities in the profile part.

The present invention will be better understood on reviewing the drawings and associated description which follows, with the same reference numbers being employed for the same parts in the various views.

BRIEF DESCRIPTION OF THE DRAWINGS

FIG. 2 is an enlarged cross-sectional view taken along reference line 2—2 of FIG. 1 wherein the zipper has a groove profile and a rib profile, the rib profile being intermittently segmented at a head of the rib profile.

FIG. 3 is an enlarged cross-sectional view of the zipper of FIG. 2, wherein the zipper has regimes of colored thermoplastic material in the rib profile including the head.

FIG. 4 is an enlarged cross-sectional view of a second embodiment of a zipper having a groove profile and a rib profile, with the rib profile being intermittently segmented at hooks of a head of the rib profile.

FIG. 5 is an enlarged cross-sectional view of a third embodiment of the zipper, wherein the zipper has a rib profile and a groove profile and the groove profile is intermittently segmented at hooks of groove arms of the groove profile.

DETAILED DESCRIPTION OF THE VARIOUS EMBODIMENTS

Figure 1:
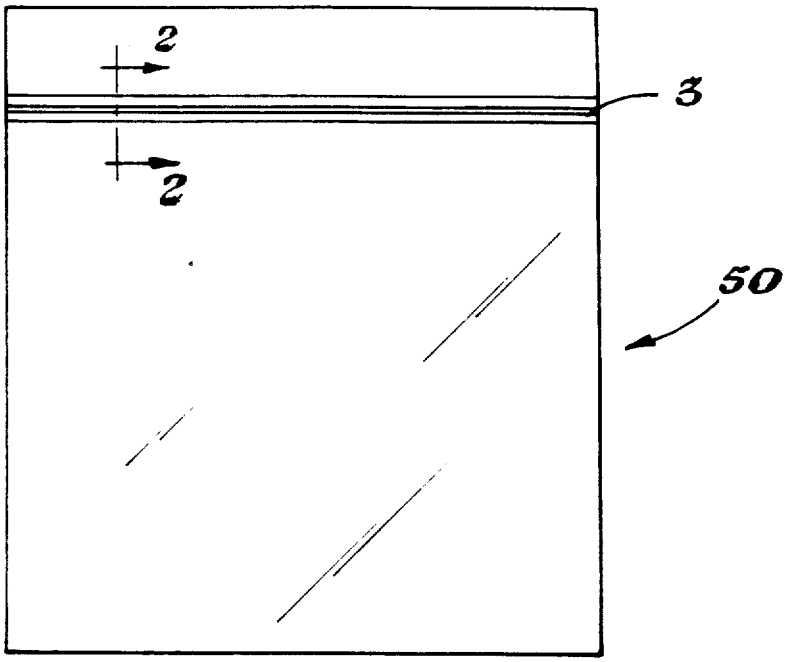
FIG. 1 is a front elevational view of a reclosable thermoplastic bag having a zipper in accordance with the present invention.

A preferred zipper 3 for a reclosable thermoplastic bag 50 is illustrated in FIG. 1. Zipper 3 is preferably continuous in length across the opening at the top of bag 50. Zipper 3 is comprised of a thermoplastic material, and can be comprised of the same or a different material as the remainder of bag 50.

Generally, zipper 3 comprises opposing, longitudinally extending interlockable rib and groove profiles (zipper profiles). At least one of the profiles is characterized by indentions spaced intermittently along its length, the indentions preferably being located along a surface of the profile adjacent a portion of the opposing profile. Preferably, the indentions are defined in and along a part of the zipper profile which is interlockable with a longitudinally extending part of the opposing zipper profile. Further preferably, the indentions and the surfaces which define or bound the indentions of the part of the zipper profile are adjacent the part of the opposing zipper profile with which it is interlocked. Further preferably, the part of the zipper profile having indentions therein is substantially free of interdigitation with the part of the opposing zipper profile with which it is interlockable.

Being substantially free of interdigitation means that the opposing profile does not substantially intrude into the cavities defined by the indentions in the profile part. Being substantially free of interdigitation is advantageous because the opposing profiles need not be mated and matched in manufacture or use of the bags to accommodate the interdigitating structures, and thus can more easily be made and interlocked. The presence of indentions in a profile or a part thereof results in the profile or profile part being structurally discontinuous along its length and having at least two different segments along its length which differ in shape. Preferably, the profile or profile part has first and second segments which alternate along the entire length of the profile. Thus, the shape of the profile or profile part in a preferred embodiment alternates between two different shapes segmentally along the profile. Either or both of the rib or the groove profiles or parts thereof may have segments of differing shapes, but preferably only the rib profile has such segments.

In an embodiment of the zipper illustrated in FIG. 2, a zipper 13 comprises opposing longitudinally extending interlockable rib profile 10 and groove profile 11. Rib profile 10 is seen in fragmentary isolation in FIG. 6.

Figure 6:
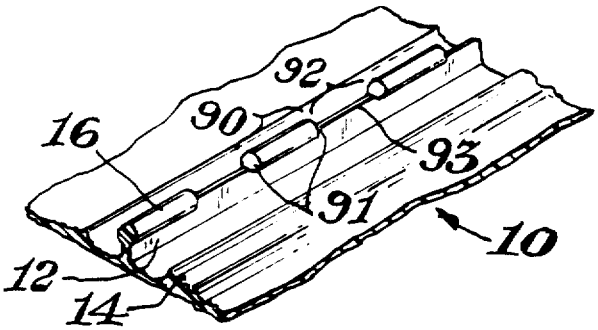
FIG. 6 is an enlarged isometric fragmentary view partly in section of the rib profile of the zipper shown in FIG. 2.

Viewing both FIGS. 2 and 6, rib profile 10 defines a bulbous head 16 which is generally triangularly shaped in cross-section, a stem 12, and optionally one or more ribs 14 adjacent stem 12. Stem 12 extends continuously along profile 10. Head 16 extends intermittently in segments along profile 10, resulting in structural discontinuity along profile 10. Rib profile 10 thus is comprised of alternating first segments 90 and second segments 92, with segments 90 and 92 having different shapes. Segment 90 has a head 16 whereas segment 92 has no such head. The indentions in and along rib profile 10 are manifest in segments 92 by the lack of such a head.

Segments 90 and head 16 have surfaces 91 which are generally planar and perpendicular to the longitudinal extension of head 16. Segments 92 define surfaces 93 which are generally planar and positioned transversely to and preferably at about right angles to surfaces 91.

Stem 12 extends from a rib base 10*a* to define head 16 at its free end intermittently along profile 10. Head 16 includes oppositely disposed outwardly extending hooks 18. Groove profile 11 includes groove arms 17 which extend from a groove base 11*a*. Groove arms 17 straddle head 16 when profiles 10 and 11 are interlocked, and define hooks 19 at the free ends of arms 17. Head 16 constitutes a longitudinally extending part of profile 10 interlockable with an essentially continuous and longitudinally extending part of profile 11, constituting groove arms 17. Hooks 19 engage and are interlockingly coextensive with the hooks 18 of head 16. Preferably, the indentions in segments 92 are substantially free of interdigitation by portions of groove arms 17.

FIG. 3 illustrates a zipper 13 with the head 16 and ribs 14 of rib profile 10 having a regime of colored thermoplastic material 15 extending longitudinally through head 16 at intervals and extending continuously and longitudinally through ribs 14. Regime 15 is positioned in profile 10 such that it is carried by a portion or portions (head 16) of profile 10 and is interrupted by indentions in and along profile 10. A distinct alternation of color akin to a dashed line along head 16 results.

When profiles 10 and 11 are interlocked while viewing through profile 11, a color change may be observed at the portion of groove profile 11 where groove arms 17 contact with the remainder of profile 11 if the virgin, untinted thermoplastic material comprising profile 11 is thick enough at that portion to be translucent instead of transparent, but not thick enough to be opaque. If that portion is translucent when rib profile 10 having colored thermoplastic material in head 16 is interlocked with groove profile 11, the color of head 16 is readily visible through the translucent portion of profile 11 and produces a color change.

Figure 7:
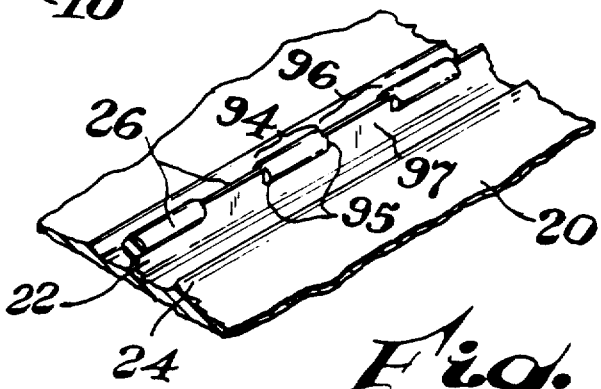
FIG. 7 is an enlarged isometric fragmentary view partly in section of the rib profile of the zipper shown in FIG. 4.

Another embodiment of the zipper of the present invention is seen in zipper 23 of FIG. 4. Zipper 23 comprises opposing longitudinally extending interlockable rib profile 20 and groove profile 21. Viewing both FIGS. 4 and 7, rib profile 20 defines a head 26, a stem 22, and optionally one or more ribs 24. Stem 22 and ribs 24 extend longitudinally along profile 20. Head 26 longitudinally extends along profile 20. Rib profile 20 defines alternating first segments 94 and second segments 96 along its length. Segments 94 and 96 have different shapes by virtue of the structural discontinuity of head 26 along profile 20. In segment 94, head 26 has outwardly extending hooks 28 whereas in segment 96 head 26 has no such hooks. The indentions within and along head 26 and rib profile 20 are manifest in segments 96 by the lack of such hooks. Segments 94 and head 26 have surfaces 95 which are generally planar and perpendicular to the longitudinal extension of head 26. Segments 96 define surfaces 97 which are generally planar and positioned at about right angles to surfaces 91. Stem 22 extends from rib base 20*a* to define head 26 at its free end. Head 26 includes oppositely disposed outwardly extending hooks 28. Groove profile 21 defines groove arms 27. Head 26 constitutes a longitudinally extending part of profile 20 interlockable with a longitudinally extending part of profile 21 in the form of groove arms 27. Groove arms 27 straddle head 26 when profiles 20 and 21 are interlocked, and define hooks 29 which engage and are interlockingly coextensive with the hooks 28 of head 26. Preferably, the indentions within segments 96 are substantially free of interdigitation by portions of groove arms 27.

Figure 9:
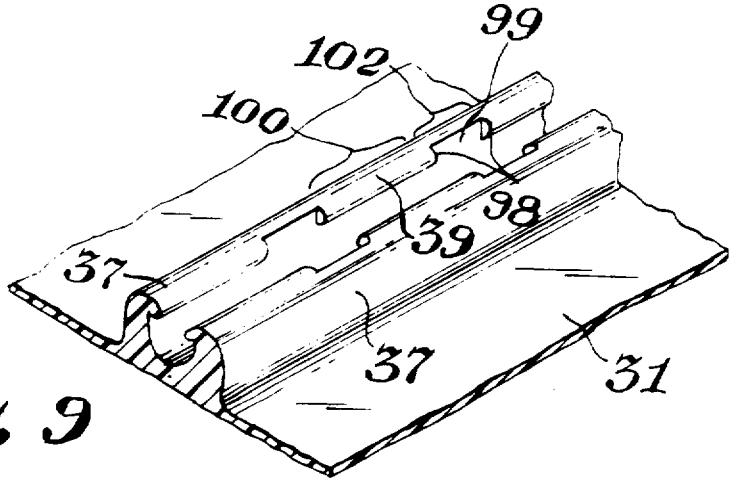
FIG. 9 is an enlarged isometric fragmentary view partly in section of the groove profile of the zipper shown in FIG. 5.

Another embodiment of the zipper of the present invention is shown in zipper 33 of FIG. 5. Zipper 33 comprises opposing longitudinally extending interlockable rib profile 30 and groove profile 31. Viewing both FIGS. 5 and 9, groove profile 31 includes groove arms 37 which extend from groove base 31*a* in a general "U" shape and which are longitudinally extending. Groove profile 31 is further characterized by intermittent and preferably alternating first and second segments 100 and 102. In segment 100, groove arms 37 have hooks 39 at their free ends whereas in segment 102 the arms 37 have no such hooks. The indentions within segments 102 are manifest by the lack of such hooks. Groove arms 37 of segments 100 have surfaces 98 which are generally planar and perpendicular to the longitudinal extension of groove arms 37. Segments 102 define surfaces 99 which are generally planar and positioned at about right angles to surfaces 98. Rib profile 31 of FIG. 5 defines a head 36. Groove arms 37 constitutes a longitudinally extending part of profile 31 interlockable with an essentially continuous and longitudinally extending part of profile 30 in the form of head 36. Groove arms 37 straddle head 36 when profiles 30 and 31 are interlocked. Head 36 has hooks 38 oppositely situated and generally perpendicularly aligned about the longitudinal extension of head 36. Head 36 defines hooks 38 which engage and are interlockingly coextensive with the hooks 39 of groove arms 37. Preferably, the indentions within segments 102 of groove arms 37 are substantially free of interdigitation by portions of head 36.

Additional embodiments (not shown) of the zipper of the present invention would have a rib profile and a groove profile with more conventional cross-sectional configurations. Instead of structural discontinuities being introduced into one or both of the rib profile and groove profile by the periodic absence of the head of the rib profile (as in FIG. 2 and 3), hooks from the head of the rib profile (FIG. 4), or hooks from the groove arms of the groove profile (FIG. 5), however, the structural discontinuity in one or both of the profiles in these alternate embodiments would be produced by intermittently increasing or decreasing the size of a profile.

Figure 23:
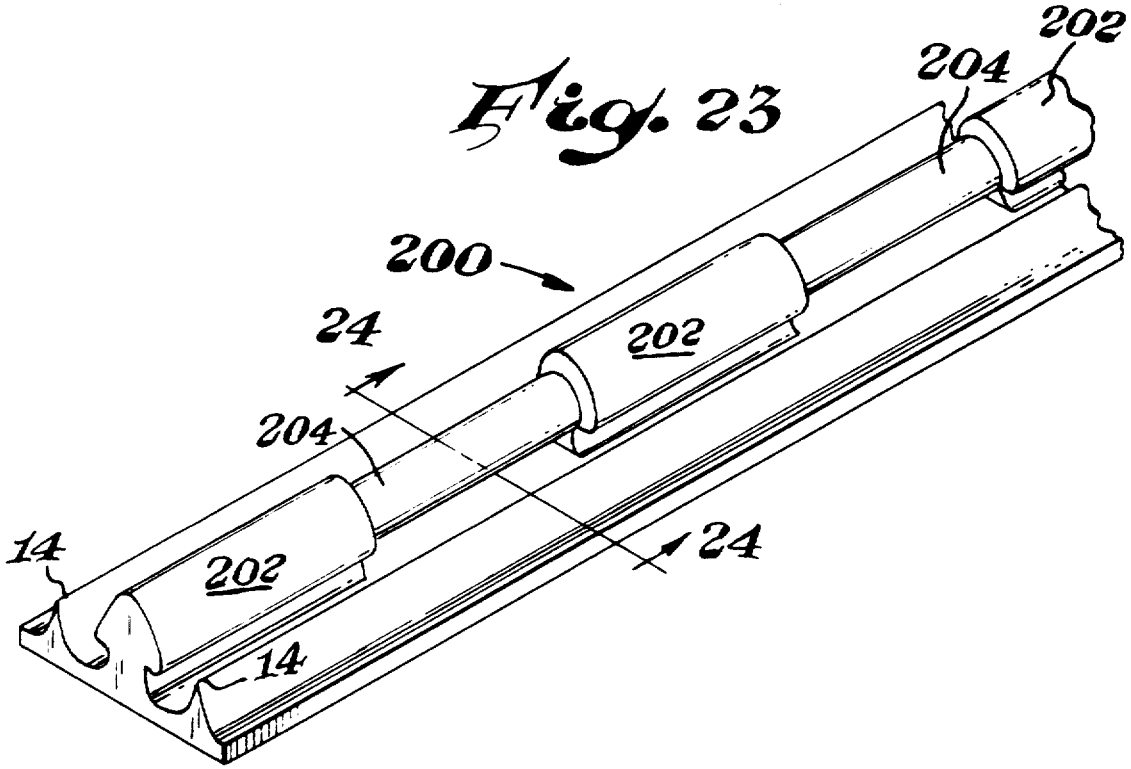
FIG. 23 is an enlarged isometric fragmentary view, partly in section, of a rib profile having segments of different sizes but a common configuration.
Figure 24:
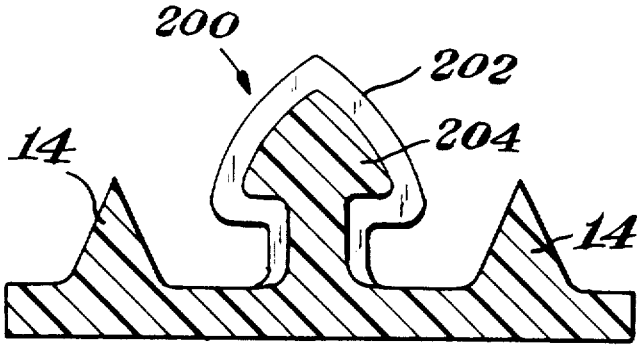
FIG. 24 is an enlarged cross-sectional view taken along reference line 24—24 of FIG. 23.

In one such embodiment, as shown in FIGS. 23 and 24 for example the rib profile will comprise segments 202 of a conventionally-sized cross-section with segments 204 of a diminished cross-section. Ribs 14 are located adjacent profile 200. It is believed that such a rib profile could be made by cycling the profile polymer flow from the extruder.

In another such embodiment, the rib profile would be of a standard consistent cross-section, but the groove profile would define segments of a conventionally-sized cross-section with preferably alternating segments of a slightly larger cross-section which do not interdigitate with the rib profile, but which still form a good seal with the rib profile. It is thought that this embodiment could be made either by cycling the profile polymer flow from the extruder for the groove profile, or by cycling the flow of the cooling water or other fluid customarily used to cool the extruded profiles and to thus maintain the profiles in their desired shapes.

Figure 8:
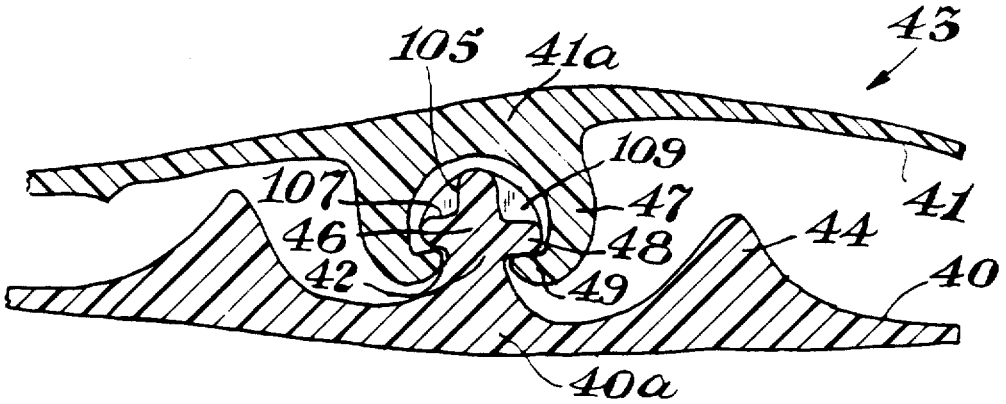
FIG. 8 is an enlarged cross-sectional view of a fourth embodiment of the zipper, wherein the zipper has a groove profile and a rib profile and the rib profile is intermittently segmented at upper lateral portions of a head of the rib profile.
Figure 10:
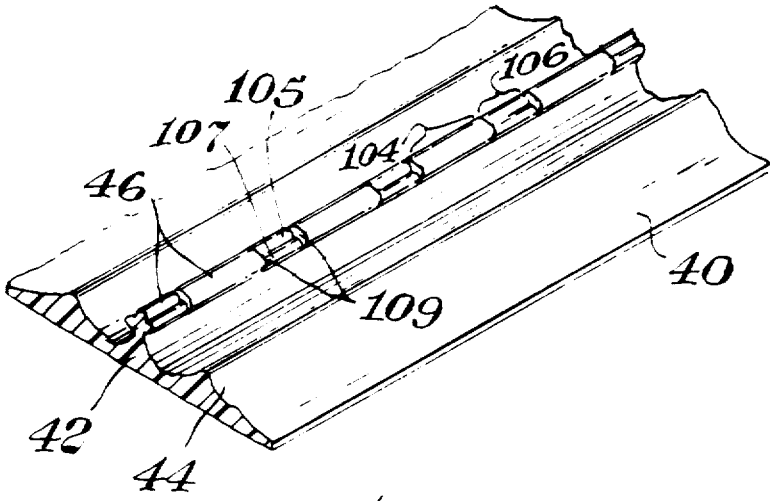
FIG. 10 is an enlarged isometric fragmentary view partly in section of the rib profile of the zipper shown in FIG. 8.

A preferred embodiment of the zipper of the present invention is shown in zipper 43 of FIG. 8. Zipper 43 comprises opposing longitudinally extending interlockable rib profile 40 and groove profile 41. Viewing both FIGS. 8 and 10, rib profile 40 defines a head 46, a stem 42, and one or more ribs 44. Rib profile 40 defines intermittent and preferably alternating first segments 104 and second segments 106. Segments 104 and 106 have different shapes. Head 46 is generally clover-shaped or clover leaf-shaped in segment 106 and preferably generally bulbous in shape in segment 104, resulting in structural discontinuity along profile 40. The term "bulbous" as used herein includes not only round cross-sections but also a generally arrow-like or triangular-shaped cross-section as is commonly seen in the art. Indentions within segments 106 are manifest by the lack of upper laterally-disposed portions of head 46 in segments 104. The upper laterally-disposed portions of head 46 are those which are present in head 46 in segment 106 but not in segment 104. Segments 104 and head 46 have surfaces 109, which are preferably generally planar and perpendicular to the longitudinal extension of head 46. Segments 106 define surfaces 105 and 107 which are preferably generally planar and positioned at about right angles with respect to each other and surfaces 109. Though shown in FIG. 10 as being situated at about right angles to surfaces 105 and 107, surfaces 109 alternately may taper at their bottoms into surfaces 105 and 107. Stem 42 extends preferably generally perpendicularly from rib base 40*a* to define head 46 at its free end. Head 46 includes oppositely disposed outwardly extending hooks 48. Head 46 constitutes a longitudinally extending part of profile 40 interlockable with a longitudinally extending part of profile 41 in the form of groove arms 47. Groove arms 47 extend from groove base 41*a* of groove profile 41. Groove arms 47 straddle head 46 when profiles 40 and 41 are interlocked, and define hooks 49 at their free ends to be engageable and interlockingly coextensive with the hooks 48 of head 46. Preferably, the indentions within segments 106 are substantially free of interdigitation with groove arms 47.

The various elements of the profiles 40 and 41 are preferably proportioned and configured so that a readily discernible indication of closure is provided when the profiles are interlocked, without at the same time compromising the seal between the profiles 40 and 41 or making the profiles 40 and 41 too stiff to close or interlock without applying excessive force. To provide an indication of the proportions of the various elements of profiles 40 and 41 with respect to one another for accomplishing these purposes, it has been found desirable for the upper laterally-disposed portions of head 46 in segments 104 to be spaced at least about 0.003 inches from groove arms 47 and the hooks 49, to prevent the laterally-disposed portions of the head 46 from pushing the groove profile 41 open. So that the profiles 40 and 41 interlock sealingly, the gap between the hooks 49 of the groove arms 47 is smaller than the width of the stem 42 of profile 40, this width preferably being from about 0.015 to about 0.020 inches.

The upper laterally-disposed portions of the head 46 are substantial enough to provide some resistance to the interlocking of profiles 40 and 41, and in this regard are each preferably from about 0.006 to about 0.012 inches thick (measured from surfaces 107 downwardly along the axis of stem 42). The upper laterally-disposed portions preferably begin at surfaces 107 a distance (along the axis of the stem 42) of from about 0.010 to about 0.019 inches from the tip of head 46.

The corresponding profile 41 is preferably dimensioned so the groove arms 47 are from about 0.015 to about 0.019 inches in width, with the hooks 49 being from about 0.006 to about 0.015 inches in width at their juncture with groove arms 47. The hooks 49 are preferably from about 0.006 to about 0.020 inches in length, and the groove base 41*a* is preferably from about 0.010 to about 0.020 inches in thickness.

Figure 12:
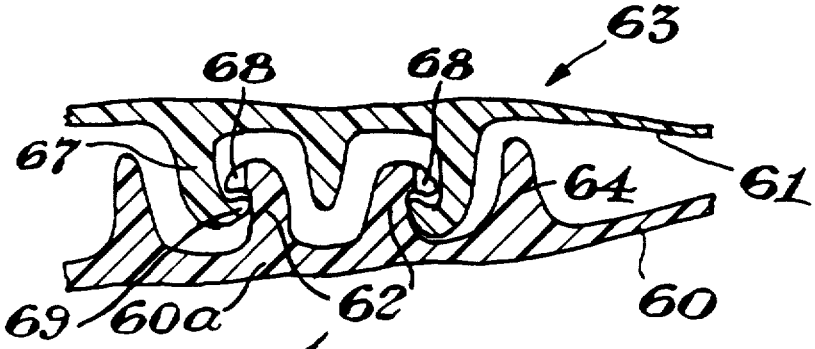
FIG. 12 is an enlarged cross-sectional view of a fifth embodiment of the zipper of FIG. 1 wherein the rib profile is intermittently segmented at hooks of the rib profile.
Figure 13:
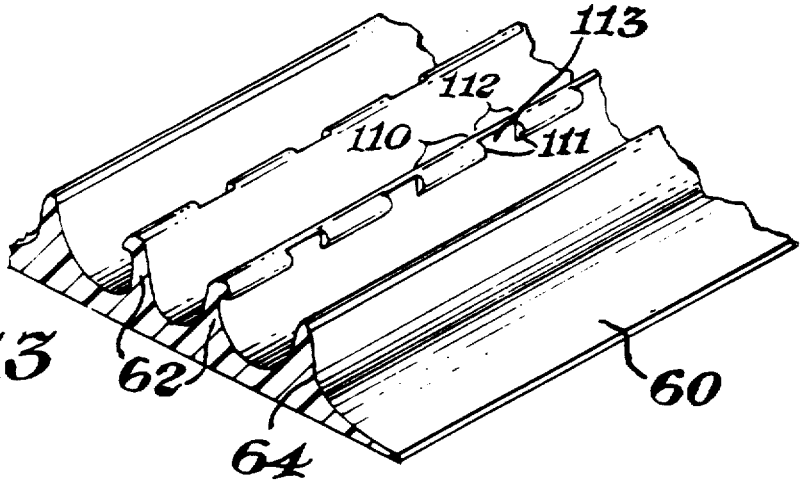
FIG. 13 is an enlarged isometric fragmentary view partly in section of the rib profile of the zipper shown in FIG. 12.

Another construction of a zipper in accordance with the present invention is seen in zipper 63 of FIG. 12. Zipper 63 comprises opposing longitudinally extending interlockable rib profile 60 and groove profile 61. Viewing both FIGS. 12 and 13, rib profile 60 defines a pair of spaced-apart, generally parallely-disposed rib arms 62 and optionally one or more ribs 64. Ribs 64 longitudinally extend along profile 60, as do rib arms 62. Rib profile 60 is characterized by intermittent and preferably alternating first and second segments 110 and 112, respectively. Segments 110 and 112 have different shapes by virtue of the different shapes of rib arms 62, resulting in structural discontinuity along profile 60. In segments 110, rib arms 62 define at their ends hooks 68 which face away from each other. In segments 112, rib arms 62 lack hooks 68 at their ends. The indentions in rib arms 62 and along rib profile 60 are manifest in segment 112 by the lack of such hooks 68. Segments 110 and rib arms 62 have surfaces 111 which are generally planar and perpendicular to the longitudinal extension of rib arms 62. Segments 112 define surfaces 113 which are generally planar and positioned at about right angles to surfaces 111. Rib arms 62 extend from rib base 60*a* of rib profile 60. Hooks 68 are spaced apart and disposed transverse or perpendicular to the longitudinal extension of rib profile 60. Rib arms 62 constitute a longitudinally extending part of profile 60 interlockable with a longitudinally extending part of profile 61 in the form of groove arms 67. Groove profile 61 defines spaced apart and generally parallely-disposed groove arms 67. Groove arms 67 straddle rib arms 62 when profiles 60 and 61 are interlocked, and at their free ends define inwardly-facing hooks 69 which engage and are interlockingly coextensive with the hooks 68 of rib arms 62. Preferably, the indentions within segments 112 are substantially free of interdigitation with groove arms 67.

Figure 11:
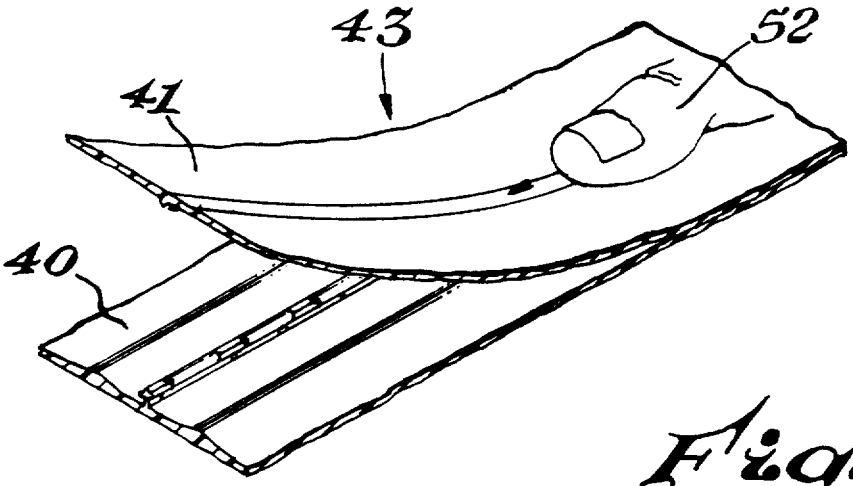
FIG. 11 is an enlarged isometric fragmentary view partly in section of the zipper shown in FIG. 8 wherein the rib and the groove profile are being interlocked by hand.

FIG. 11 shows the zipper 43 of a preferred embodiment being interlocked by thumb 52. While not bound by any particular theory, the audible clicking sound and the vibratory or bumpy feel associated with the zipper 43 are believed to result from hooks 49 of groove arms 47 contacting planar surfaces 107 and 109 of head 46 as rib and groove profiles 40 and 41 are interlocked from one end of zipper 43 to the other, or from one point along zipper 43 to another point along the same zipper 43.

The present invention is not limited to the disclosed embodiments. The art is replete with zippers and reclosable fasteners of different structures and configurations adaptable to thermoplastic bags. Examples of this art are seen in U.S. Pat. Nos. 4,363,345, 4,561,109, and 4,528,224. It will be seen from the foregoing that such prior art zipper structures can readily be modified in accordance with the present invention to form a zipper having the desired audible clicking and/or vibratory and bumpy feel when the zipper is closed or zipped.

Without being bound by any particular theory, it is believed that the means by which the zippers of the present invention produce an audible clicking sound and/or have a vibratory or bumpy feel when the zipper profiles are interlocked is the presence of an intermittent discontinuity in structure along portions of either or both of the rib or groove profiles. The discontinuity in structure is typically in those portions of the opposing profiles which in conventional constructions contact each other when a zipper is zipped.

The audible clicking and vibratory or bumpy feel on zipping are considered separable features of the present invention. A zipper may accordingly produce a vibratory or bumpy feel when zipped without imparting an audible clicking sound and still be within the scope of the present invention.

Zippers of the present invention may have three or more intermittent or alternating segments of differing shape along a profile, but preferably have intermittent or alternating segments of two different shapes as in each of the embodiments illustrated herein. The segments of differing shape may be of equal or unequal length. Preferably, the segments having indentions within them are of lesser relative length than those segments not having indentions within them so as to minimize the likelihood or incidence of liquid leakage through the interlocked zipper. The segments having indentions within them have an incidence along a profile preferably of from 1 to 8, more preferably 3 to 6, and most preferably 5 such segments per inch of profile. The length of each segment having an indention within it is preferably from about ⅛th to about 1/32nd and most preferably about 1/16th of an inch.

The terms "rib profile" and "groove profile" are used herein as terms of convenience to describe opposing interlockable male and female zipper profiles, and are not to be construed as limiting.

Zippers of the present invention may have either or both of the zipper profiles comprised in whole or in part of a "colored" thermoplastic material. "Colored" means that the thermoplastic may be tinted transparent, tinted translucent, or tinted opaque relative to the transparent look or lack of tint or color normally associated with virgin thermoplastic materials.

Zippers of the present invention may in this respect have opposing rib and groove profiles, wherein each profile is transparent or translucent and of a different color. The opposing profiles may then be interlocked to produce a predetermined third color. For instance, a profile having a blue color and an opposing profile having a yellow profile could be interlocked to produce a green color and to thus provide added assurance of proper engagement of the profiles.

Zippers of the present invention preferably are substantially leakproof. Surfaces of the interlockable rib and groove profiles preferably form a contiguous or snug fit with each other along the zipper.

The zipper profiles of those zipper embodiments employing larger- and smaller-cross-section segments of a profile may as suggested earlier be capable of being produced by direct extrusion of the segmented profile, as by periodically restricting polymer flow leading to the profile plate or by cycling cooling water flow to a profile. The zipper profiles (rib or groove) of the zippers shown in FIGS. 2–13 may also be capable of being formed by direct extrusion of a profile having indentions in and along its length, but are preferably formed by directly extruding the profile without indentions in and along its length and subsequently imparting indentions in and along the profile by deforming and/or removing portions of the profile.

Turning now to apparatus for making a logitudinally extending zipper for a reclosable thermoplastic bag, one such apparatus comprises a means for providing a first zipper profile having a longitudinally extending part interlockable with a longitudinally extending opposing second zipper profile, a means for aligning the first profile in a fixed position, a means for deforming the part to form indentions therein intermittently along the length of the part, a means for providing the second zipper profile, and a means for interlocking the first and second profiles such that the indentions within the part are substantially free of interdigitation with portions of the second profile. In an alternate apparatus, the means for deforming the part may be replaced by a means for removing portions of the part.

The means for providing the first and second zipper profiles may comprise an extruder (not shown) and a die means (not shown) to shape the profile as is common in the art. The means for providing the first and second zipper profiles may also comprise a means for advancing the profiles.

The means for deforming or removing portions of the part renders the profile part structurally discontinuous along its length, and forms at least first and second segments of differing shapes along the length of the part. Preferably, a profile configuration results from the deforming or removing of portions of the profile wherein the first and second segments alternate along the length of a first profile. A preferred part for the first zipper profile takes the form of a bulbous head, so that deforming or removing portions of the part comprises deforming or removing portions of the bulbous head. Most preferably, portions of the bulbous head are intermittently deformed so that a first profile is formed which is characterized by alternating first and second segments along the length of the bulbous head, wherein the first segment is bulbous and the second segment is generally clover-shaped.

The means for interlocking the opposing first and second profiles may take the form of juxtaposed closing rollers (not shown) common in the art. The opposing profiles are interlocked as they pass between the closing rollers. The opposing profiles may also be interlocked by hand as seen in FIG. 11. The interlocking means will interlock the opposing profiles such that the indentions or structural discontinuities generally within the part are substantially free of interdigitation with portions of the second profile. Preferably, the interlocking means interlocks the first profile with a second zipper profile which is longitudinally extending and which is essentially continuous in cross-section or in structure, in that it does not define projections extending therefrom or indentions therein along its length. The second profile may also have indentions therein along its length, however.

Figure 14:
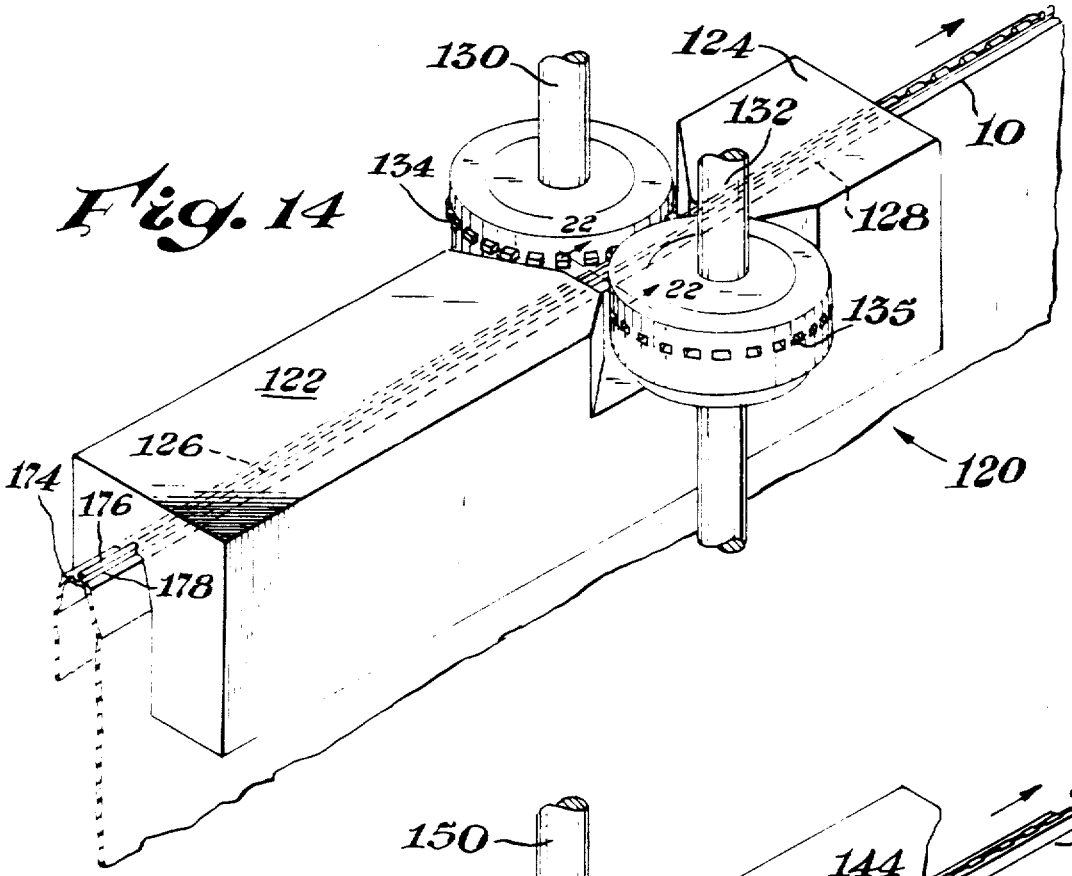
FIG. 14 is an isometric view of a punching apparatus according to the present invention, wherein a zipper profile being processed therethrough is shown fragmentarily.
Figure 22:
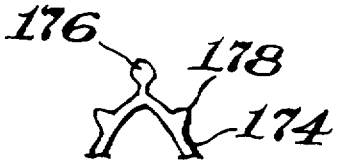
FIG. 22 is an enlarged cross-sectional view taken along a reference line 22—22 of FIG. 14 of the zipper profile as it exits a first channel block and enters a punching means of the punching apparatus.

A means for removing protions of the bulbous head may comprise a means for punching out portions of the bulbous head, such as for forming the zipper shown in FIG. 6. The punching means may comprise a means for intermittently or continually laterally punching out a portion of the head. A lateral punching means is shown as punching apparatus 120 in FIGS. 14 and 16. Punching apparatus 120 intermittently punches out a portion of a part, such as a head 176, of a first zipper profile such as a rib profile 174 which is interlockable with an opposing groove profile. A rib profile is formed like that shown as profile 10 in FIGS. 2, 3, 6, 14 and 16. Punching apparatus 120 is hereafter described with reference to rib profiles 174 and 10 for purposes of convenience and illustration. Rib profile 174 is seen in FIGS. 14 and 22 as the rib profile entering punching apparatus 120. Apparatus 120 intermittently punches out head 176 of rib profile 174 to form rib profile 10 wherein profile 10 has first and second segments 90 and 92.

The means for aligning the profile in a fixed position in apparatus 120 comprises first and second channel blocks 122 and 124, respectively. Channel blocks 122 and 124 have channels 126 and 128, respectively, extending therethrough from one end to the other, and are designed to receive and convey the rib profile. Channels 126 and 128 may be designed to accomodate rib profiles 174 and 10 only or the same rib profiles and adjoining bag film web protions with which rib profile 174 may have been integrally formed or to which profile 174 may have been laminated. Channels 126 and 128 are preferably in vertical and horizontal alignment with each other. Channel 126 is configured to convey rib profile 174 so that the sides of head 176 may be contacted by punches 134 laterally and perpendicularly to the longitudinal extension of head 176 without obstruction by ribs 178, as seen in FIG. 22. Channel 126 may be configured to lift head 176, or, more preferably, to merely force ribs 178 outward out of position whereby the punches 134 have lateral access to head 176. Channel 126 is preferably configured to receive rib profile 174 in its normal posture, wherein head 176 is generally horizontally level with ribs 178 as seen in FIG. 14 and with other rib profiles such as in FIGS. 2, 4, and 5. Channel 126 preferably gradually changes in configuration from one end to the other, from a shape corresponding to the level posture of the rib profile to one which corresponds to the desired posture wherein unobstructed lateral access is afforded to the head of the rib profile. Channel 128 is preferably configured to receive rib profile 10 in the desired arched posture at its entrance, and gradually changes in configuration to a shape at its exit consistent with the level posture of profile 10 seen in FIG. 6 or seen downstream of apparatus 120 in FIG. 14.

Figure 16:
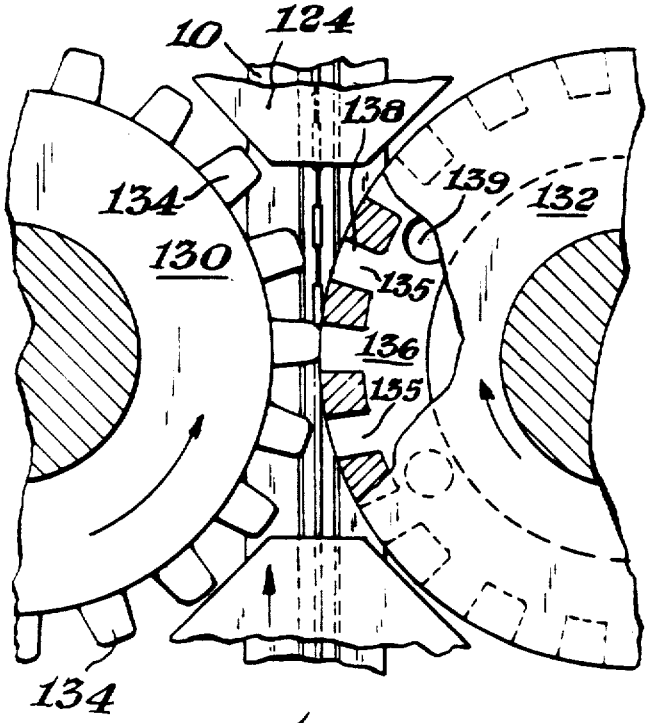
FIG. 16 is an enlarged fragmentary top view of the apparatus of FIG. 14.

The means for intermittently laterally punching out the head of the rib profile comprises first and second rotary members 130 and 132, respectively. Rotary members 130 and 132 are situated between channel blocks 122 and 124, respectively. First rotary member 130 has a plurality of radially situated, outwardly-projecting punches 134. Second rotary member 132 defines a plurality of radially situated bores 135 and a cavity 136 therein. Bores 135 extend from cavity 136 to openings 138 located at the periphery of member 132. Rotary members 130 and 132 are preferably situated with respect to each other so that the front-most portions of punches 134 extend through openings 138 into bores 135 in operation of the apparatus 120. Preferably, punches 134 extend into openings 138 and bores 138 only about one one-thousandth of an inch at the point of greatest penetration. The front corners of punches 134 are preferably inwardly tapered as seen in FIG. 16, and most preferably have a taper of about 7°. The width of punches 134 is preferably about twice their height. Punches 134 and bores 135 are spaced about rotary members 130 and 132, respectively, in a pitch corresponding to the desired frequency of indentions within or removed portions from the passing rib profile.

Rib profile 174 is thus passed through channel 126 of channel block 122 and between the revolving and intermating punches 134 and bores 135 of rotary members 130 and 132 to form rib profile 10, which is then passed through channel 128 of channel block 132. In this process, head 176 of rib profile 174 is passed between rotary members 130 and 132 and punches 80 excise portions of the head 176 through bores 135. Bores 135 receive these excised portions, and as the excised portions accumulate in bores 135 the portions are passed into cavity 136. Cavity 136 extends radially within and around rotary member 132 and receives the excised portions. Cavity 136 contains cavity openings 139, which allow excised portions of head 176 to exit or fall out of cavity 136 as excised portions accumulate there.

Means in the apparatus 120 for advancing rib profiles 174 and 10 preferably comprise rotary members 130 and 132, which act to pull rib profile 174 therebetween by compression between punches 134 and bores 135 as members 130 and 132 are rotated. Rotary members 130 and 132 may be rotated by mechanical or electromechanical means known in the art (not shown). Other conceivable means for advancing rib profile 174 and 10 include mechanized feed and takeup rolls (not shown).

Figure 15:
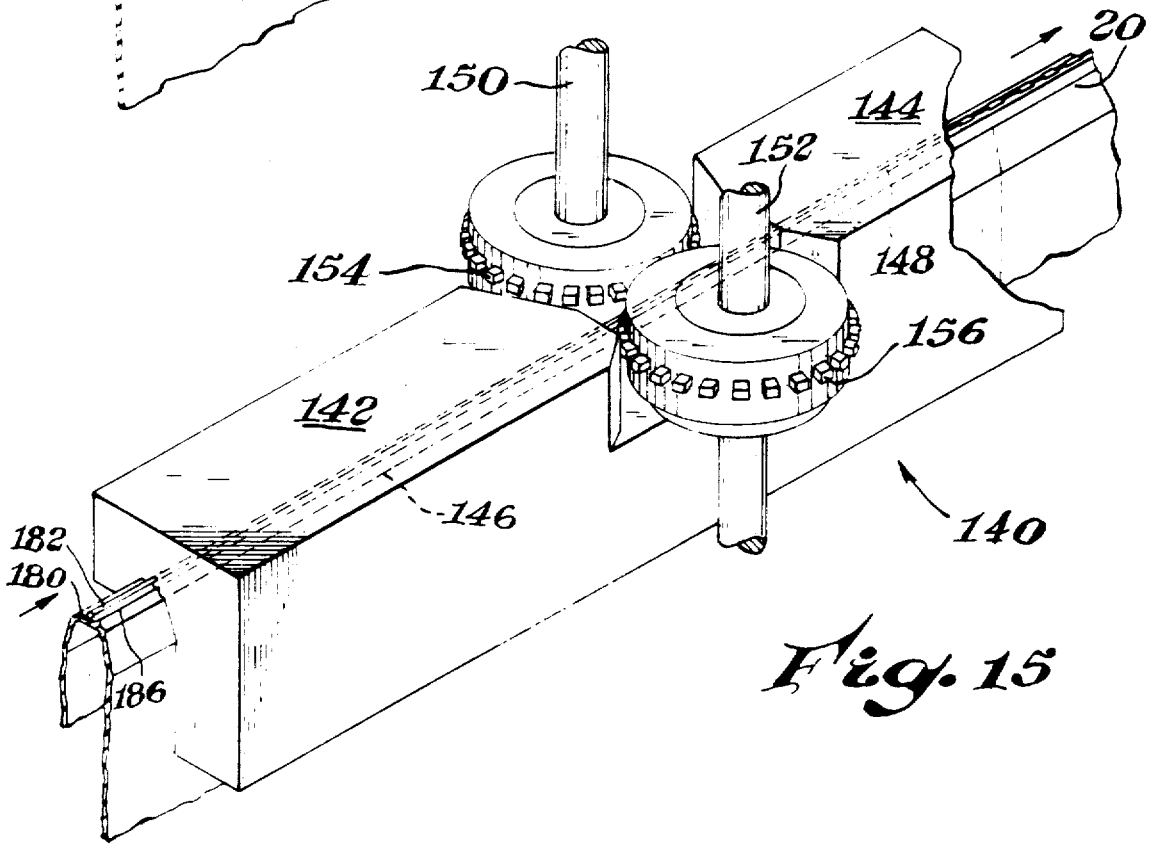
FIG. 15 is an isometric fragmentary view of a deforming apparatus according to the present invention, wherein a zipper profile being processed therethrough is shown fragmentarily.
Figure 17:
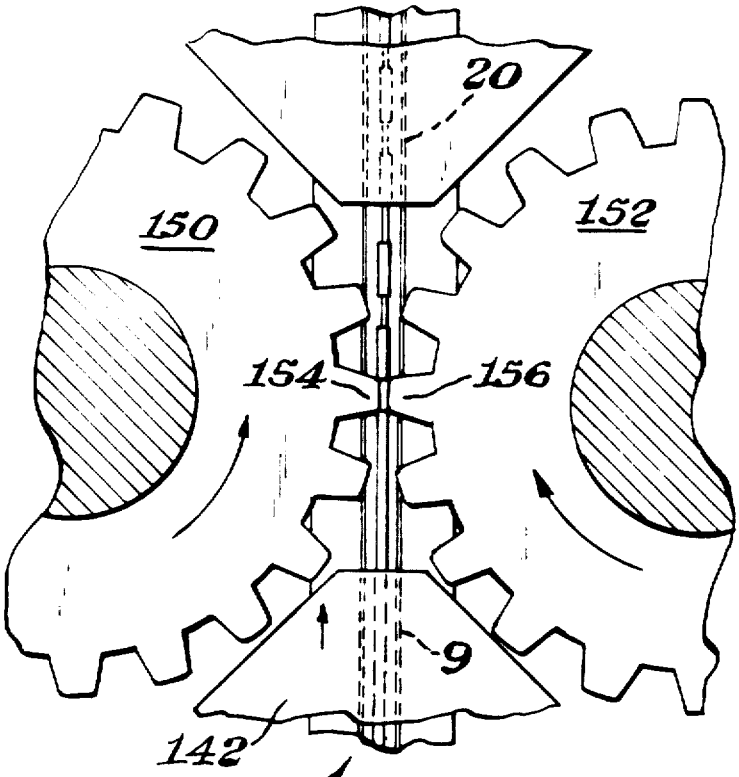
FIG. 17 is an enlarged fragmentary top view of the apparatus of FIG. 15.

A means for deforming a rib profile is shown in FIGS. 15 and 17, and is referred to hereafter as deforming apparatus 140. Deforming apparatus 140 intermittently deforms a part of a rib profile 180 which is interlockable with an opposing groove profile, such as head 182, to form a profile similar to that shown as profile 20 in FIGS. 2, 3, 4, 7 and 15. Rib profile 180 may have ribs 186 extending therefrom on either side of head 182. Deforming apparatus 140 is hereafter described with reference to profiles 9 and 20 for purposes of convenience and illustration. Deforming apparatus 120 has a means for deforming the head of the rib profile, comprising a means for positioning and aligning the profile and a means for deforming the head of the rib profile.

The means for positioning and aligning rib profile 20 comprises first and second channel blocks 142 and 144, respectively. Channel blocks 142 and 144 have channels 146 and 148, respectively, defined therethrough. The structure and function of channel blocks 142 and 144 is substantially the same as that of channel blocks 122 and 124 of punching apparatus 120.

The means for deforming the head of the rib profile in deforming apparatus 140 comprises a means for intermittently laterally deforming the head of the rib profile. The lateral deforming means comprises first and second rotary members 150 and 152, respectively. First and second rotary members 150 and 152 each have a plurality of radially situated, outwardly-projecting teeth 154 and 156, respectfully. Rotary members 150 and 152 are positioned with respect to each other so that teeth 154 and 156 of each are spaced apart but aligned as members 150 and 152 are each rotated in opposite directions. Members 150 and 152 are further positioned such that the front portions of teeth 154 and 156 contact and straddle the lateral portions or sides of head 182 of passing rib profile 180, but do not excise it. Teeth 154 and 156 are spaced about rotary members 150 and 152, respectively, in a pitch corresponding to the desired frequency of indentions within head 182. Rotary members 150 and 152 are situated between channel blocks 142 and 144, respectively.

The means for advancing rib profiles 9 and 20 preferably comprise rotary members 150 and 152, which may be mechanized to pull rib profiles 9 therethrough by compression between teeth 154 and 156 as members 150 and 152 are rotated. Other conceivable means for advancing rib profiles 9 and 20 include mechanized feed and takeup rolls (not shown).

Figure 18:
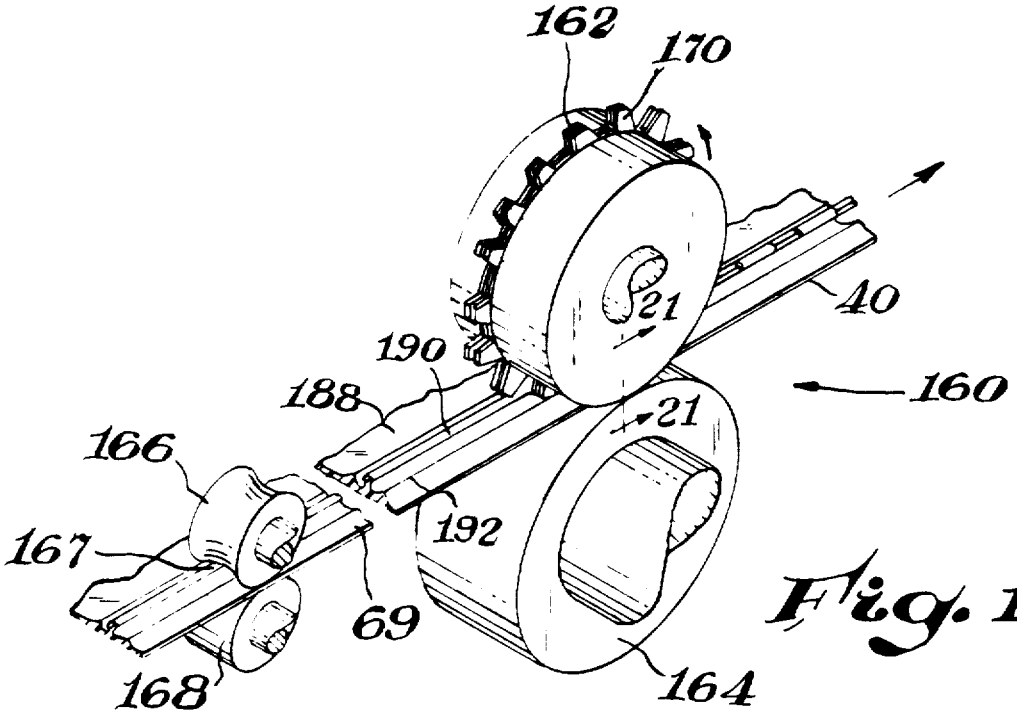
FIG. 18 is an enlarged fragmentary isometric view of another embodiment of a deforming apparatus, through which a zipper profile is being processed.

A preferred means for deforming a rib profile is shown in FIG. 18, and is referred to hereafter as deforming apparatus 160. Deforming apparatus 160 intermittently deforms a head 190 of a rib profile 188 to form a profile like that shown as profile 40 in FIGS. 8, 9, and 18. Profile 188 may further have ribs 192 extending therefrom on either side of head 190. Deforming apparatus 160 is hereafter described with reference to profiles 6 and 40 for purposes of convenience and illustration. Deforming apparatus 160 has a means for deforming the zipper profile, which comprises a means for positioning and aligning the profile and a means for deforming the head of the rib profile.

The means for positioning and aligning the rib profile may comprise rollers 166 and 168 located upstream of the means for deforming the rib profile, as seen in FIG. 18. Rollers 166 and 168 are positioned above and below the rib profile 188. Roller 166 preferably has a concave surface, and roller 168 has a concave or planar surface but preferably has a planar surface. Rollers 166 and 168 define a cavity 167 therebetween for receiving rib profile 188.

Figure 21:
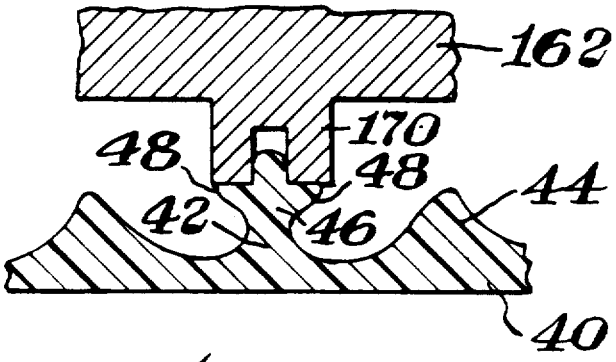
FIG. 21 is a greatly enlarged cross-sectional view taken along a reference line 21—21 of FIG. 18 of a tooth of the deforming apparatus contacting the zipper profile.

The means for deforming the head of the rib profile comprise first and second rotary members 162 and 164. First rotary member 162 has a plurality of radially situated, outwardly-projecting, spaced-apart, generally U-shaped teeth 170. Second rotary member 164 preferably has a circular planar surface, but a mere flat planar surface (not shown) could be used in place of rotary member 164. First member 162 is positioned above and second member 164 below zipper profile 188 and head 190 in operation of the apparatus, and preferably in general vertical alignment as seen in FIG. 18. First member 162 is positioned so that the front portions of each tooth 170 partially intersect head 190 when that tooth 170 is generally normal or perpendicular to head 190, as seen in FIG. 21. Teeth 170 are spaced about rotary member 162 in a pitch corresponding to the desired frequency of indentions within head 190 of passing rib profile 188.

Figure 20:
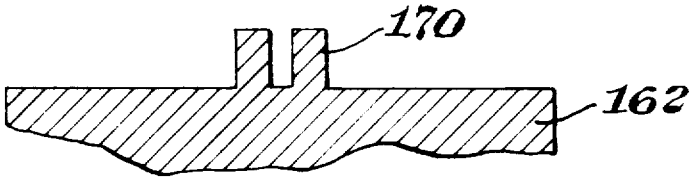
FIG. 20 is a greatly enlarged fragmentary cross-sectional view of the tooth of FIG. 17.
Figure 19:
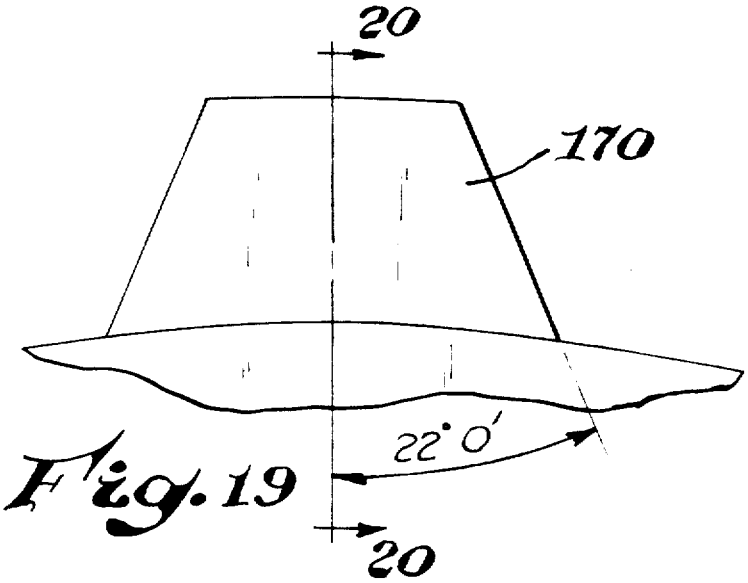
FIG. 19 is a greatly enlarged side view of a tooth of a rotary member of the deforming apparatus of FIG. 17.

Teeth 170 are preferably generally U-shaped or slit-shaped as shown in FIG. 20. First member 162 is positioned so that each tooth 170 intersects the upper lateral portions of head 190 when that tooth 170 is generally normal or perpendicular to head 190, as seen in profile 40 of FIG. 21. The sides of the teeth 170 are preferably tapered as shown in FIG. 19, with the most preferred angle of taper as indicated.

Means for advancing rib profiles 6 and 40 preferably comprise mechanized feed and takeup rolls (not shown). Other conceivable means for advancing the profiles 6 and 40 include the rotary members 162 and 164, which may be mechanized to pull rib profiles 9 and 40 therethrough by compression between them as they (rotary members 162 and 164) are rotated.

The means in deforming apparatus 140 for deforming the head 190 in the manner of FIG. 21 could comprise in another embodiment a single-toothed reciprocating block (not shown). This block would descend on the head 190 and deform head 190, and then be retracted to a position above the advancing rib profile 188. The block would have the same U- or slit-shaped cross-section as the teeth 170 of the first rotary member 162, and would deform the head 190 in the same fashion as teeth 170. The block would be synchronized to descend on the head 190 with the desired frequency of indentions in head 190.

The reciprocations of the block in this regard might preferably be synchronized with a sealing apparatus for the reclosable plastic bags of which these zippers form a part, so that the deforming apparatus 140 is adjusted to different line speeds for producing the bags. It is considered that the reciprocating block in this embodiment of the deforming apparatus will normally operate in association with a flat planar surface positioned below the advancing profile 188, and with mechanized feed and takeup rolls for advancing the profile through the apparatus.

Processes of the present invention for making a longitudinally extending zipper for a reclosable thermoplastic bag generally comprise providing a first zipper profile having a longitudinally extending part interlockable with an opposing second profile, deforming or removing portions of the part intermittently along the length of the part, providing a longitudinally extending second zipper profile, and interlocking the first and second profiles such that the indentions or discontinuities within the part are substantially free of interdigitation with portions of the second profile. Either or both of the zipper profiles may be provided by extrusion of thermoplastic material through a die of the desired profile configuration, as is common in the art.

Preferably, the first profile is interlocked with a second zipper profile which is longitudinally extending and essentially continuous in structure or cross-section. Deforming or removing portions of a part of the first profile renders the part structurally discontinuous along its length and forms the first and second differently-shaped segments along the length of the part. Preferably, deforming or removing portions of the part forms a profile configuration wherein the first and second segments alternate along the length of the profile. A preferred part for the first zipper profile takes the form of a bulbous head.

Providing the first zipper profile thus preferably comprises providing a first zipper profile having a longitudinally extending bulbous head which is interlockable with the opposing zipper profile. Deforming or removing portions of the head preferably forms intermittent and preferably alternating first and second segments along the length of the bulbous head wherein the first segment is bulbous and the second segment is generally clover-shaped.

While several specific embodiments of the invention have been shown and described in some detail, it will be appreciated that a number of other embodiments are possible which are still fairly within the scope of the general teachings and principles found herein.

What is claimed is:

1. A zipper for a reclosable thermoplastic bag, comprising two opposing, longitudinally extending interlockable rib and groove profiles configured so that a part of at least one of the profiles is structurally discontinuous along its length and substantially free of interdigitation with the opposing profile when interlocked therewith, the structural discontinuities along the length of the part defining at least first and second segments therein characterized by cross-sections of different sizes but a common configuration imparting a vibratory or bumpy feel perceptible to the touch or an audible clicking sound continually therealong when the profiles are interlocked or separated from each other.

2. A zipper as defined in claim 1, wherein a part of the rib profile is so segmented while the groove profile is of a consistent cross-sectional size.

3. A zipper as defined in claim 2, wherein the part is a longitudinally extending head of the rib profile and the first and second segments alternate along its length.

4. A zipper as defined in claim 3, wherein the rib profile is of a consistent cross-sectional size while a part of the groove profile is segmented.

5. A reclosable thermoplastic bag having the zipper of claims 1, 2, 3 or 4 about an opening thereof.

6. A reclosable thermoplastic bag as defined in claim 5, wherein the zipper forms a substantially leakproof seal at the bag opening.

7. A process for making a thermoplastic zipper for a reclosable thermoplastic bag, comprising the steps of:

a) continuously extruding a longitudinally extending first zipper profile having a part interlockable with a longitudinally extending opposing second zipper profile while restricting at intervals the flow of molten polymer to a profile plate for forming the first zipper profile, whereby the part of the first zipper profile is made intermittently structurally discontinuous along its length and defines at least first and second segments therein characterized by cross-sections of different sizes but a common configuration imparting a vibratory or bumpy feel perceptible to the touch or an audible clicking sound continually therealong when the profiles are interlocked or separated from each other;

b) providing a second zipper profile; and c) interlocking the first and second profiles so that the segmented part of the first profile is substantially free of interdigitation with the second profile.

8. A reclosable thermoplastic bag having a zipper made by the process of claim 7 about an opening of the bag.

9. A process for making a thermoplastic zipper for a reclosable thermoplastic bag, comprising the steps of:

a) continuously extruding a longitudinally extending groove profile having a part interlockable with a longitudinally extending opposing rib profile;

b) intermittently increasing or intermittently decreasing the flow of a cooling fluid against the freshly-extruded groove profile, whereby the part of the groove profile is made intermittently structurally discontinuous along its length and defines at least first and second segments therein characterized by cross-sections of different sizes but a common configuration imparting a vibratory or bumpy feel perceptible to the touch or an audible clicking sound continually therealong when the profiles are interlocked or separated from each other;

c) providing a rib profile; and d) interlocking the groove and rib profiles so that the segmented part of the groove profile is substantially free of interdigitation with the rib profile.

10. A reclosable thermoplastic bag having a zipper made by the process of claim 9 about an opening of the bag.

11. A reclosable thermoplastic bag as defined in claim 10, wherein the zipper made by the process of claim 9 is substantially leakproof over the length of the segmented part of the groove profile.

12. An apparatus for making a longitudinally extending zipper for a reclosable thermoplastic bag, comprising:

(a) means for providing a longitudinally extending first profile having a longitudinally extending part interlockable with a longitudinally extending opposing second zipper profile;

(b) means for deforming the part to form indentions therein intermittently along its length at a desired spacing at any selected linespeed;

(c) means for providing the second zipper profile;

(d) means for interlocking the first and second profiles such that the indentions within the part are substantially free of interdigitation with portions of the second profile; and (e) said first and second profiles characterized by cross-sections of different sizes but a common configuration to impart a vibratory or bumpy feel perceptible to the touch or an audible clicking sound continually therealong when the profiles are interlocked or separated from each other.

* * * * *